US012391439B1

(12) United States Patent
Wisniewski

(10) Patent No.: US 12,391,439 B1
(45) Date of Patent: Aug. 19, 2025

(54) DISPENSING CLOSURE WITH TAMPER EVIDENCE FEATURES

(71) Applicant: AptarGroup, Inc., Crystal Lake, IL (US)

(72) Inventor: John Wisniewski, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 18/998,176

(22) PCT Filed: Aug. 28, 2024

(86) PCT No.: PCT/US2024/044104
§ 371 (c)(1),
(2) Date: Jan. 24, 2025

(87) PCT Pub. No.: WO2025/049519
PCT Pub. Date: Mar. 6, 2025

Related U.S. Application Data

(63) Continuation-in-part of application No. PCT/US2023/031226, filed on Aug. 28, 2023.

(51) Int. Cl.
*B65D 47/08* (2006.01)
*B65D 55/02* (2006.01)

(52) U.S. Cl.
CPC ..... *B65D 47/0838* (2013.01); *B65D 55/028* (2013.01)

(58) Field of Classification Search
CPC ..... B65D 47/0838; B65D 55/028
See application file for complete search history.

(56) References Cited

U.S. PATENT DOCUMENTS 5,538,154 A 7/1996 Von Holdt
6,269,986 B1 * 8/2001 Gross ..... B65D 47/0804 222/153.06

(Continued)

FOREIGN PATENT DOCUMENTS

DE 202009000138 U1 * 4/2009 ..... B65D 47/0838
EP 1892194 A1 * 2/2008 ..... B65D 47/0804

(Continued)

OTHER PUBLICATIONS

International Search Report and Written Opinion mailed on Dec. 17, 2024 for PCT/US2024/044104 of which this is the U.S. national phase application.

*Primary Examiner* — Bob Zadeh
(74) *Attorney, Agent, or Firm* — Wood, Phillips, Katz, Clark & Mortimer

(57) ABSTRACT

A dispensing closure (40) with non-frangible tamper evidence features includes a body (54) having a locking pin (68) with an initial configuration and a locking configuration moved relative to the initial configuration when engaged by a portion of a container (44) or a spout (60). The closure (40) includes a lid (56) connected to the body (54) and is movable between an initially closed position, an open position, and a subsequently closed position returned from the open position. The lid (56) has an aperture (94) and a tamper evidence tab (96), wherein, in the initially closed position of the lid (56), the locking pin (68) is located in the locking configuration and the tamper evidence tab (94) is retained beneath the locking pin (68). In the subsequently closed position of the lid (56), the tamper evidence tab (94) is rotated laterally outwardly into the aperture (94) to indicate evidence of tampering to a user.

17 Claims, 14 Drawing Sheets

(56) References Cited

U.S. PATENT DOCUMENTS

| | | | | |
|---|---|---|---|---|
| 8,292,101 | B1 * | 10/2012 | Bragg | B65D 47/0838 220/254.5 |
| 9,884,706 | B1 * | 2/2018 | Skillin | B65D 47/32 |
| 2010/0264145 | A1 | 10/2010 | Benoit-Gonin et al. | |
| 2012/0279966 | A1 * | 11/2012 | Mazurkiewicz | B65D 55/024 220/257.1 |
| 2016/0244219 | A1 | 8/2016 | Benoit-Gonin et al. | |
| 2016/0368674 | A1 * | 12/2016 | Ferrari | B65D 47/0804 |
| 2021/0261308 | A1 * | 8/2021 | Ferrari | B65D 47/0804 |

FOREIGN PATENT DOCUMENTS

| | | | | |
|---|---|---|---|---|
| FR | 2922869 | A1 * | 5/2009 | B65D 47/0838 |
| WO | 2012136230 | A1 | 10/2012 | |
| WO | 2015128071 | A1 | 9/2015 | |
| WO | WO-2025048774 | A1 * | 3/2025 | |
| WO | WO-2025049519 | A1 * | 3/2025 | |

* cited by examiner

FIG. 9
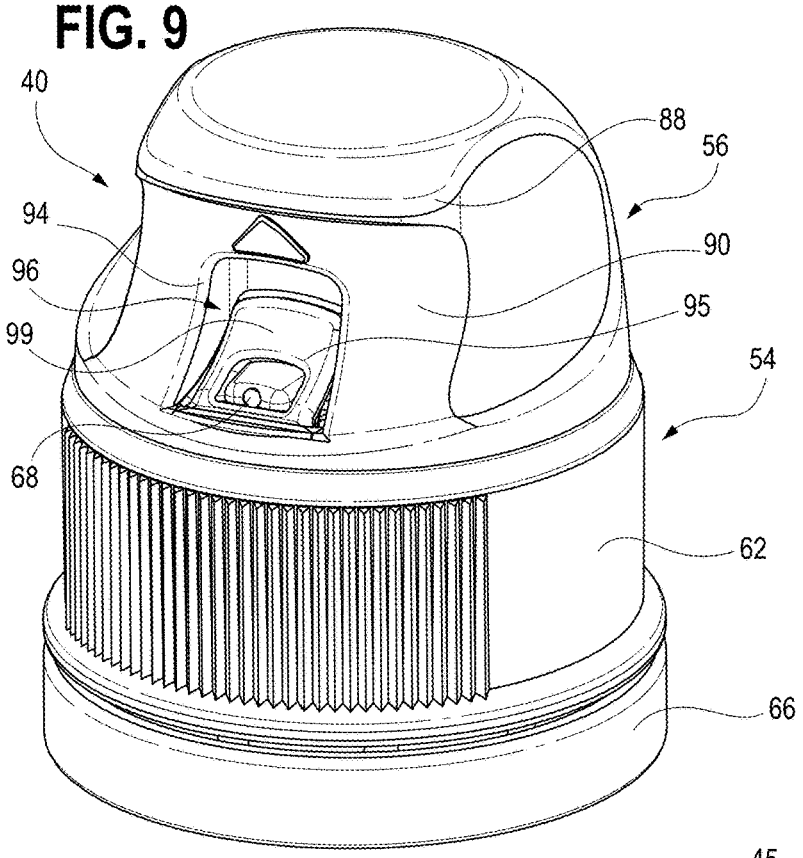
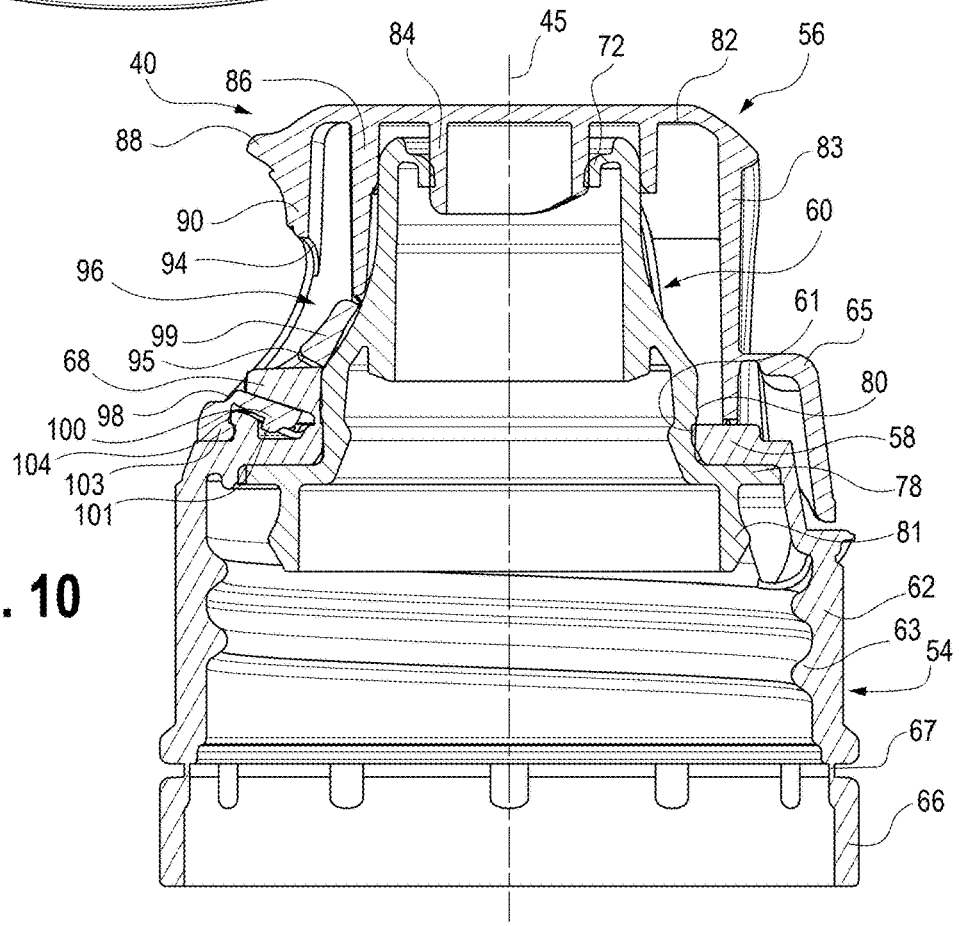
FIG. 10

FIG. 11
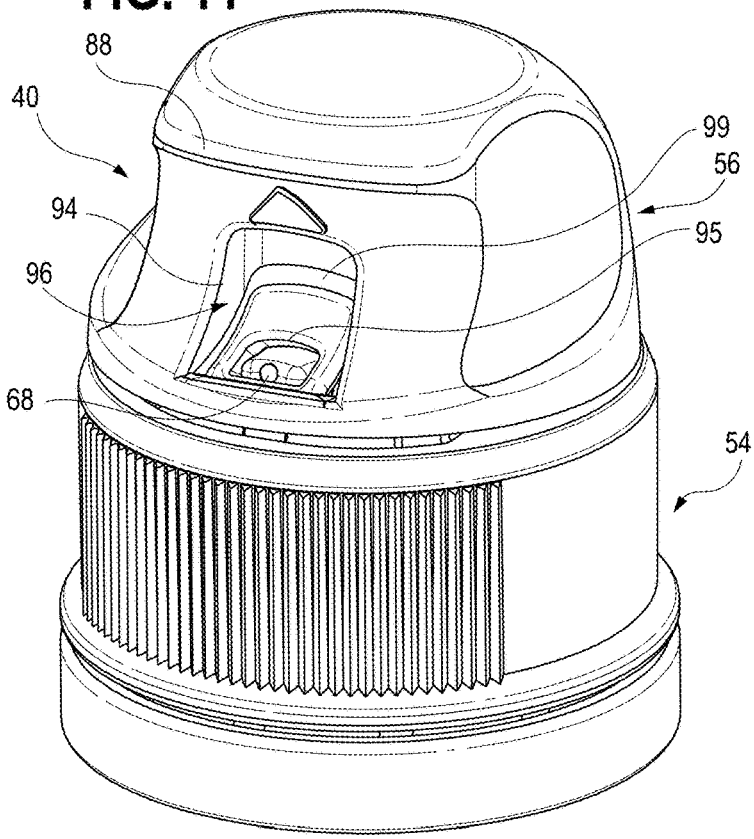
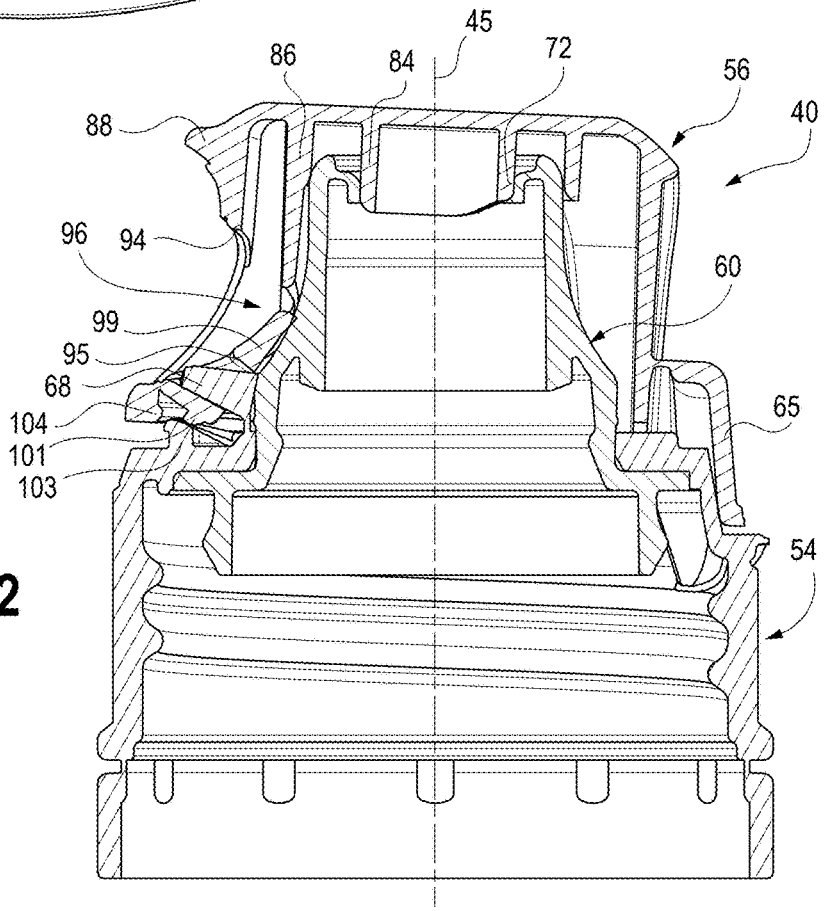
FIG. 12

FIG. 15
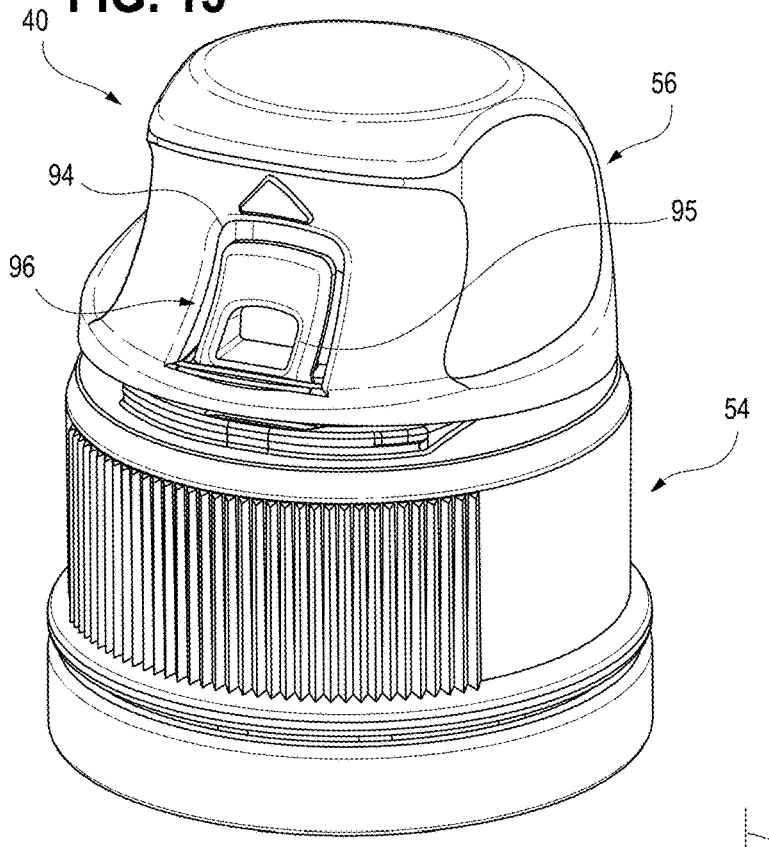
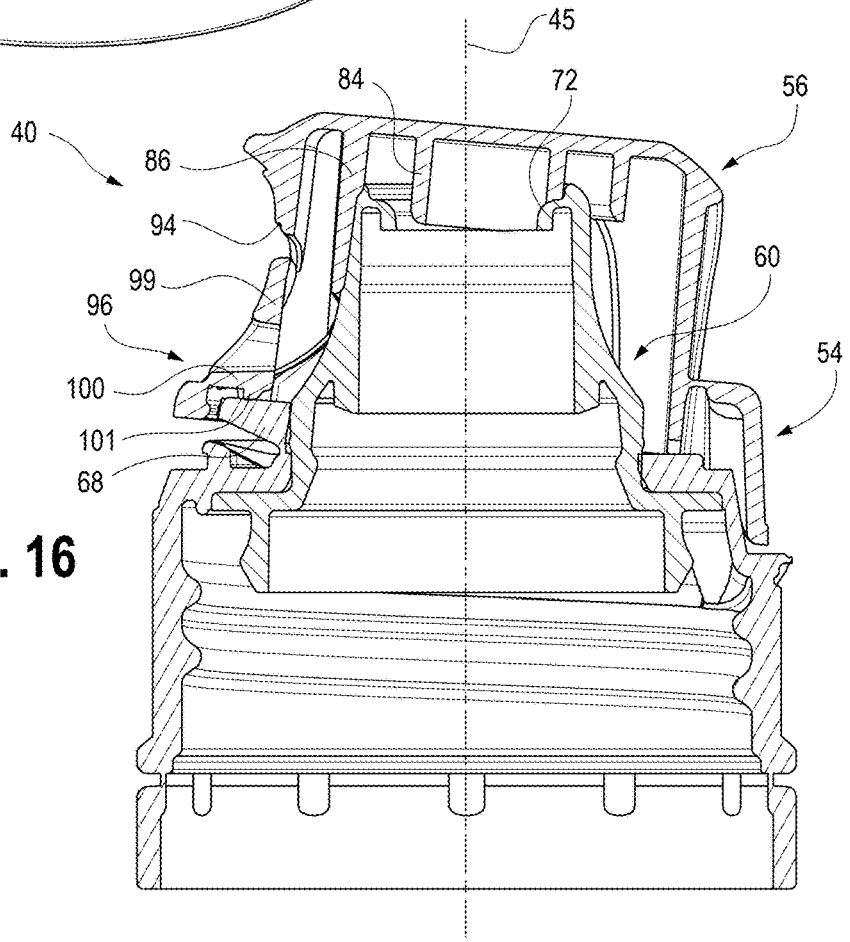
FIG. 16

FIG. 17
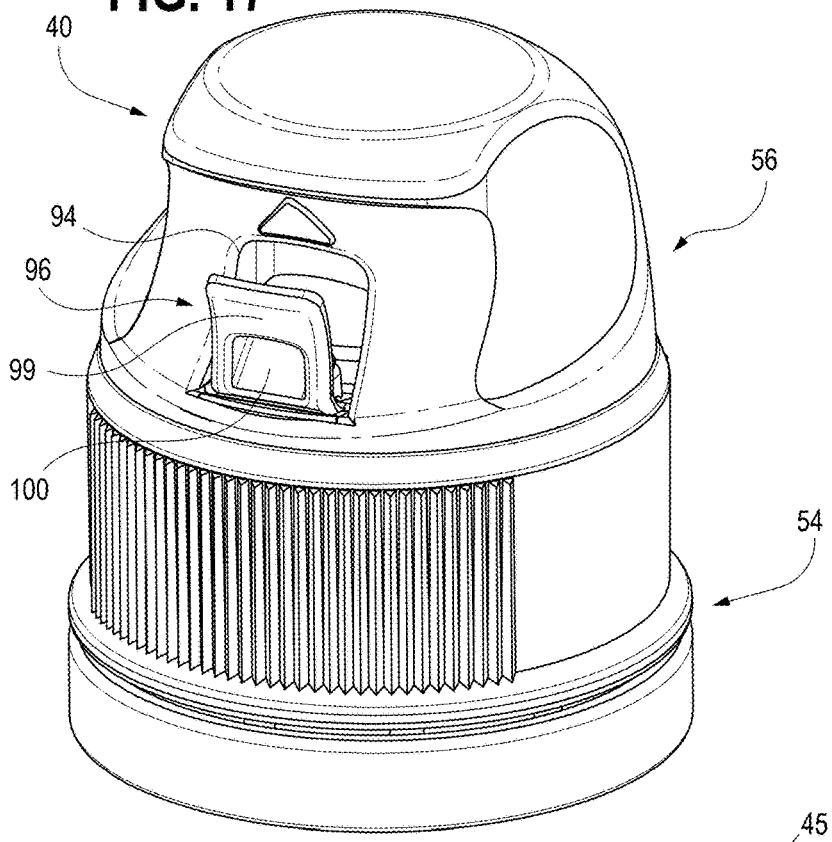
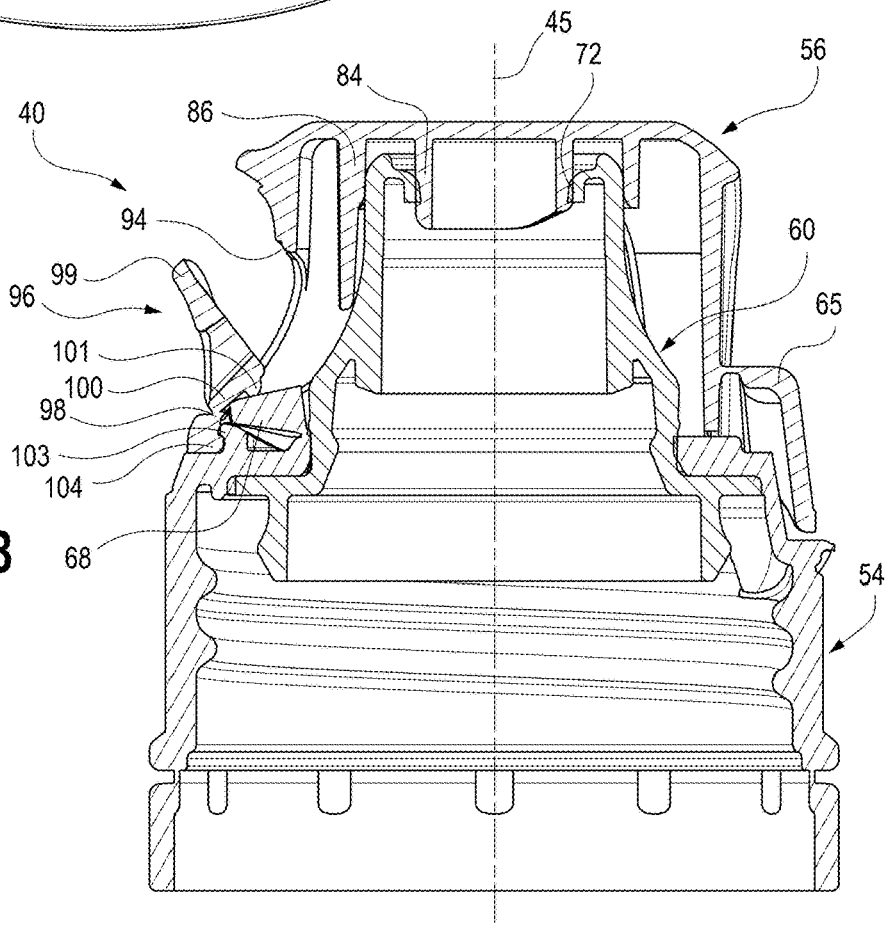
FIG. 18

DISPENSING CLOSURE WITH TAMPER EVIDENCE FEATURES

PRIORITY

The present application claims priority to International Patent Application No. PCT/US23/31226, filed on Aug. 28, 2023, the entire contents of which is incorporated herein by reference in its entirety.

TECHNICAL FIELD

This invention relates to a closure, the components of the closure, the package onto which the closure is installed, and methods of manufacturing and using the closure and/or package, wherein the closure can initially prevent, but can be subsequently opened to permit, communication (e.g., flow or other movement) of a substance between the exterior and interior of a container upon which the closure is installed.

BACKGROUND OF THE INVENTION AND TECHNICAL PROBLEMS POSED BY THE PRIOR ART

Closures are employed to selectively prevent or permit communication of a substance between the exterior and interior of a container (e.g., flexible pouch, rigid bottle, machine, dispensing equipment, containment system, etc.) through an opening in the container. Various fluent and non-fluent substances (including lotions, creams, food items, granules, liquids, powders, small articles, etc.) may be packaged in a container. A typical closure includes a (1) body (e.g., pouch fitment, screw or snap-fit base, structure, etc.) located at an opening to the container interior, and (2) a closing element (e.g., a lid, cover, overcap, etc.).

The closure body can typically be either (1) a separate structure that (a) can be attached at such a container opening, and (b) defines at least one passage through the body for communicating through such a container opening with the interior of such a container, or (2) an integral structure that is a unitary portion of such a container and that defines at least one passage through the integral structure such that the passage functions as the opening, per se, to the container.

The closing element typically accommodates movement relative to the body passage between (1) a closed position occluding the passage, and (2) an open position at least partially exposing the passage.

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. The container with the closure mounted thereon, and the contents stored therein, may be characterized as a "package".

Many common prior art closures include tamper evidence features that rely on frangible or breakable tear bands and one-way snap fit elements that retain the closing element securely until initially opened by a user. These prior art features are often removed or change their position upon lifting the closing element to visibly reveal to the consumer that the closure has been initially opened. These removable and/or moveable prior art tamper evidence features are often retained by thin frangible elements that are difficult to mold and do not present a consistent tear force or breakage force to the user. Prior art frangible tabs often require in-mold closing of the closing element due to the difficulty of machine handling of these delicate, flexible features. Also, for small diameter closures there is very limited space for the incorporation of drop pockets or shielding walls that visibly hide the moveable or breakable features. Often these prior art features require a larger closure diameter or interfere with the useable height of the dispensing spout or other dispensing structure of the closure.

The inventor of the present invention has determined that it would be desirable to provide an improved dispensing closure, wherein the tamper evidence features would remain with the body and the closing element after initial opening of the closure, and such features would engage during assembly of the spout as a subassembly or during the assembly onto a container.

It would be beneficial if such an improved dispensing closure could be relatively easily operated, without requiring an unusually complex manipulation or series of manipulations by a user.

It would also be beneficial if such an improved dispensing closure could be relatively easy to manufacture and assemble with a container, and could contain robust, non-frangible tamper evidence features to reduce the likelihood of damage thereto during assembly and/or shipping and handling.

Further, it would be desirable if such an improved dispensing closure could be opened or operated without generating smaller, separate removable waste frangible elements that produce sharp edges.

The inventor of the present invention has also discovered that it would be desirable to provide, at least for some applications, an improved assembly of a closure with non-frangible tamper evidence features, and a package that can be manufactured and/or assembled at a relatively low cost, and can accommodate manufacture by means of efficient, high-quality, large-volume techniques, and that can facilitate the minimization of plastic and part weight.

The inventor of the present invention has discovered how to provide such an improved closure that includes novel, advantageous features not heretofore taught or contemplated by the prior art, and which can accommodate designs having one or more of the above-discussed benefits or features.

SUMMARY OF THE INVENTION

In accordance with one broad form of the present invention, a dispensing closure for use in dispensing a substance that may be stored within an interior of a container includes a body for being located at the opening of the container. The body includes a deck with at least one orifice and a skirt depending from the deck with means for attaching the body to the container. The body has a locking pin extending therefrom with an initial configuration and a locking configuration moved relative to the initial configuration. The closure includes a spout retained within the body. The spout defines an inlet orifice, a dispensing orifice, and a dispensing passage extending through the spout to accommodate flow of a substance from the interior of the container through the spout. The locking pin is located in the locking configuration with the spout retained within the body. The closure includes a lid connected to the body and movable between an initially closed position occluding the dispensing orifice of the spout, an open position exposing the dispensing orifice of the spout, and a subsequently closed position returned from the open position and occluding the dispensing orifice of the spout. The lid includes an aperture and a tamper evidence tab, wherein, in the initially closed position of the lid, the locking pin is located in the locking configuration within the aperture and the tamper evidence tab is retained beneath the locking pin. In the subsequently closed position of the lid returned from the open position, the tamper evidence tab is rotated laterally outwardly into the aperture to indicate evidence of tampering to a user of the closure.

According to one preferred form of the present invention, the locking pin is configured to rotate between its initial configuration and its locking configuration by insertion of the spout within the body of the closure.

In another preferred form of the present invention, the locking pin extends substantially parallel to a central axis of the body in its initial configuration, and the locking pin extends transverse to the central axis in the locking configuration.

According to another form of the present invention, the tamper evidence tab is configured to rotate into the aperture in the lid by contact with the locking pin during movement of the lid from the open position to the subsequently closed position.

According to yet another preferred form of the present invention, the tamper evidence tab defines a projection on a lower side that engages the locking pin during movement of the lid from the open position to the subsequently closed position. Preferably, the tamper evidence tab is configured to produce an audible and/or tactile indication to a user of the closure when the lid is first moved from its initially closed position into its open position.

In yet another aspect of the present invention, the tamper evidence tab of the lid is connected to the lid by a non-frangible hinge. The locking pin is also preferably connected to the body by a non-frangible hinge.

According to another form of the present invention, the tamper evidence tab includes a tab window defined between an upper portion and lower portion for receiving the locking pin with the lid in the initially closed position and the locking pin in the locking configuration.

In one aspect of the present invention, the upper portion is recessed within the aperture of the lid in the initially closed position.

In another aspect of the present invention, the upper portion extends transversely to the lower portion when viewed in a cross-sectional plane extending through a central axis of the body and a center of the tamper evidence tab.

In still another aspect of the present invention, the locking pin has an inclined lower surface for contacting the lower portion of the tamper evidence tab with the lid in the initially closed position and the locking pin in the locking configuration.

In yet another aspect of the present invention, the deck has a deck latch portion, and the lid has a lid latch portion, wherein the deck latch portion and the lid latch portion cooperatively engage to maintain the lid in the initially closed position. The deck latch portion is located on the body to confront the tamper evidence tab with the lid in the initially closed position and the locking pin in the locking configuration.

According to another aspect of the present invention, the tamper evidence tab contacts the spout with the lid located in the initially closed position and the locking pin in the locking configuration.

According to yet another aspect of the present invention, the spout has a tapering exterior surface and a flange extending radially around the tapering exterior surface configured such that contact between the tapering exterior surface and the locking pin rotates the locking pin into its locking configuration.

In another form of the present invention, the dispensing closure is provided in combination with a container of a fluent substance. The closure and the container of the fluent substance together forming a package.

In accordance with yet another broad form of the present invention, a method of manufacturing a dispensing closure is disclosed, wherein the method includes the step of obtaining a body for being located at the opening of the container. The body includes a deck with at least one orifice and a skirt depending from the deck with means for attaching the body to the container. The body has a locking pin extending therefrom with an initial configuration and a locking configuration moved relative to the initial configuration. The body includes a lid connected thereto and movable between an initially closed position, an open position, and a subsequently closed position returned from the open position. The lid includes an aperture and a tamper evidence tab. The method includes the step of obtaining a spout defining an inlet orifice, a dispensing orifice, and a dispensing passage extending through the spout to accommodate flow of a substance through the spout. The method includes the step of inserting the spout through the orifice in the body with the lid in its initially closed position whereby the spout moves the locking pin into the locking configuration within the aperture and the tamper evidence tab is retained beneath the locking pin.

In accordance with another broad form of the present invention, a method of opening a package is disclosed, wherein the method includes the step of obtaining a package including a container and a dispensing closure installed upon the container. The dispensing closure is of the type having a body located at the opening of the container. The body has a deck including at least one orifice. The body has a skirt depending from the deck with means for attaching said body to the container. The body further has a locking pin extending therefrom with an initial configuration and a locking configuration moved relative to the initial configuration. The dispensing closure has a spout retained within the body. The spout defines an inlet orifice, a dispensing orifice, and a dispensing passage extending through the spout to accommodate flow of a substance from the interior of the container through the spout. With the spout retained within the body, the locking pin is located in the locking configuration. The dispensing closure further has a lid connected to the body and is movable between an initially closed position occluding the dispensing orifice of the spout, an open position exposing the dispensing orifice of the spout, and a subsequently closed position returned from the open position and occluding the dispensing orifice of the spout. The lid has an aperture and a tamper evidence tab, wherein, in the initially closed position of the lid, the locking pin is located in the locking configuration and the tamper evidence tab is retained beneath the locking pin. The method includes the step of moving the lid from the initially closed position to the open position. The method includes the further step of moving the lid from the open position to the subsequently closed position, wherein the tamper evidence tab is rotated laterally outwardly into the aperture by the locking pin to indicate evidence of tampering to a user of the closure.

Other objects, features, and advantages of the invention will become apparent from a review of the entire specification, including the appended claims and drawings.

BRIEF DESCRIPTION OF THE DRAWINGS

FIG. 1 shows the dispensing closure as it would appear to a user or consumer as part of a package;

FIG. 2 shows the dispensing closure prior to full assembly with a spout;

FIG. 8 shows the spout just prior to engagement with the locking pin of the body;

FIG. 9 is an isometric view, from the top front and right side, of the dispensing closure similar to that shown in FIG. 2, however, FIG. 9 shows the dispensing closure after the spout has been fully inserted into the body thus moving the locking pin through the aperture in the lid into the locking configuration of the pin as would be initially encountered by a user of the closure;

FIG. 10 is a cross-sectional view of the dispensing closure shown in FIG. 9, taken generally along the same view plane 8-8 in FIG. 4, and FIG. 9 shows the lid in the initially closed position with the locking pin rotated by engagement with the spout to retain and retain a lower portion of the tamper evidence tab;

FIG. 11 is an isometric view, from the top front and right side, of the dispensing closure that is similar to FIG. 9, however, FIG. 11 shows the lid being lifted or moved by a user away from the initially closed position toward an open position for the first time;

FIG. 12 is a cross-sectional view of the dispensing closure shown in FIG. 11, taken generally along the same view plane 8-8 in FIG. 4, and FIG. 12 shows the tamper evidence tab and locking pin stretching just prior to the tamper evidence tab slipping past the locking pin to emit an audible and/or tactile indication to a user;

FIG. 13 shows the lid moved into a fully open position permitting dispensing through the dispensing orifice of the spout;

FIG. 15 is an isometric view, from the top front and right side, of the dispensing closure similar to FIG. 13, however, FIG. 15 shows the lid moved from the fully open position toward a subsequently closed position;

FIG. 16 is a cross-sectional view of the dispensing closure shown in FIG. 15, taken generally along the same view plane 8-8 in FIG. 4, and FIG. 16 shows the tamper evidence tab contacting the locking pin as the lid moves toward the subsequently closed position-which begins to urge the tamper evidence tab outwardly through the aperture in the lid and away from the spout;

FIG. 17 is an isometric view, from the top front and right side, of the dispensing closure similar to FIG. 15, however, FIG. 17 shows the lid moved into a subsequently closed position;

FIG. 18 is a cross-sectional view of the dispensing closure shown in FIG. 17, taken generally along view plane 8-8 in FIG. 4, and FIG. 18 shows the tamper evidence tab rotated through the aperture in the lid and laterally outward of the locking pin to indicate tampering or previous opening of the closure;

FIG. 19 shows the lid in its initially closed position (prior to actuation or opening);

DESCRIPTION OF THE PREFERRED EMBODIMENTS

While this invention is susceptible of embodiment in many different forms, this specification and the accompanying drawings disclose only some specific forms as examples of the invention. However, the invention is not intended to be limited in its broadest form to just the embodiments so described. The scope of the invention is pointed out in the appended claims.

Figure 1:
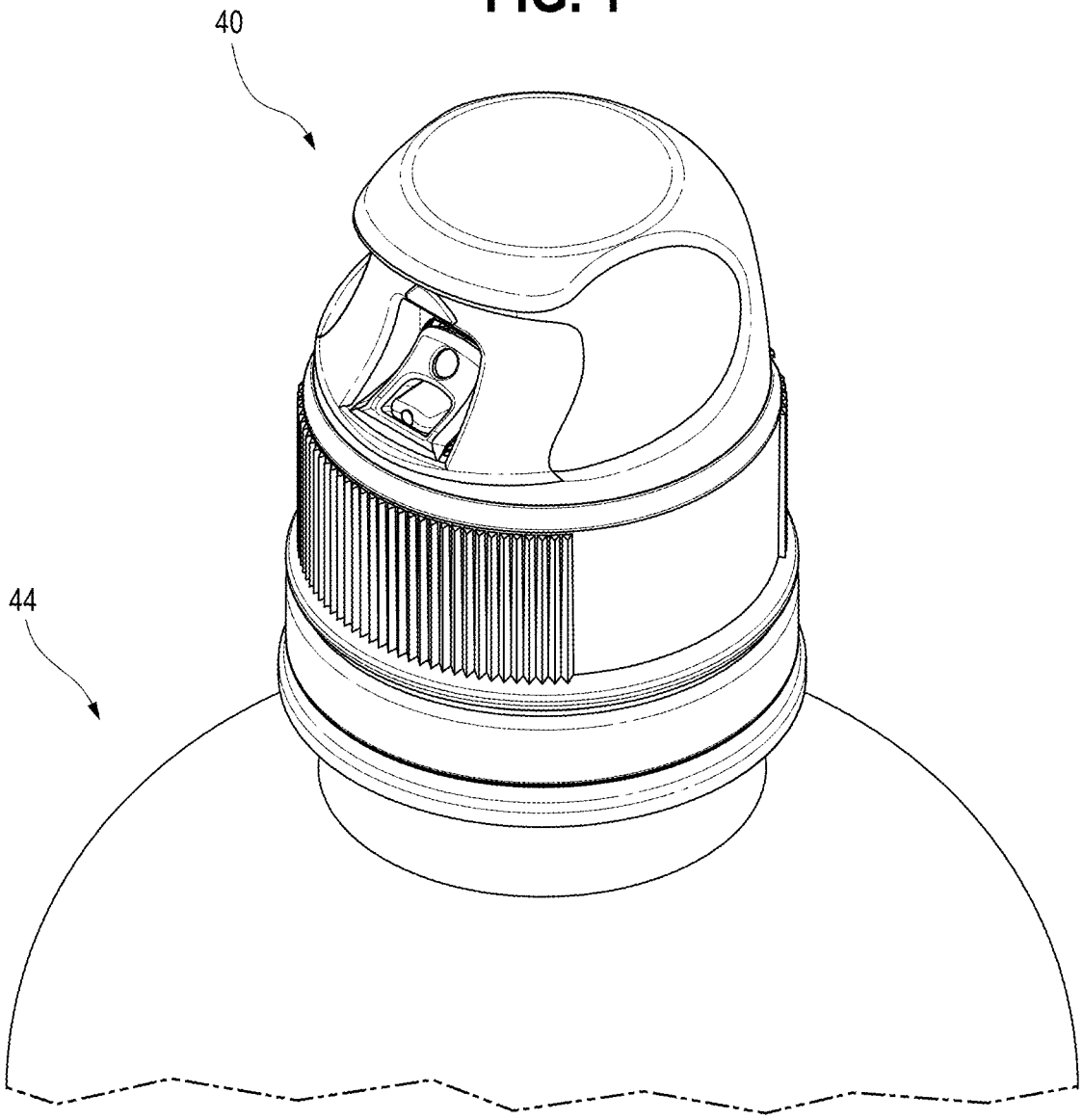
FIG. 1 is an isometric view, from the top front and right side, of a preferred embodiment of a dispensing closure of the present invention with the lid shown in an initially closed, unactuated, position and with the closure installed at the opening of a fragmentary upper portion of a container in the form of a bottle.
Figure 2:
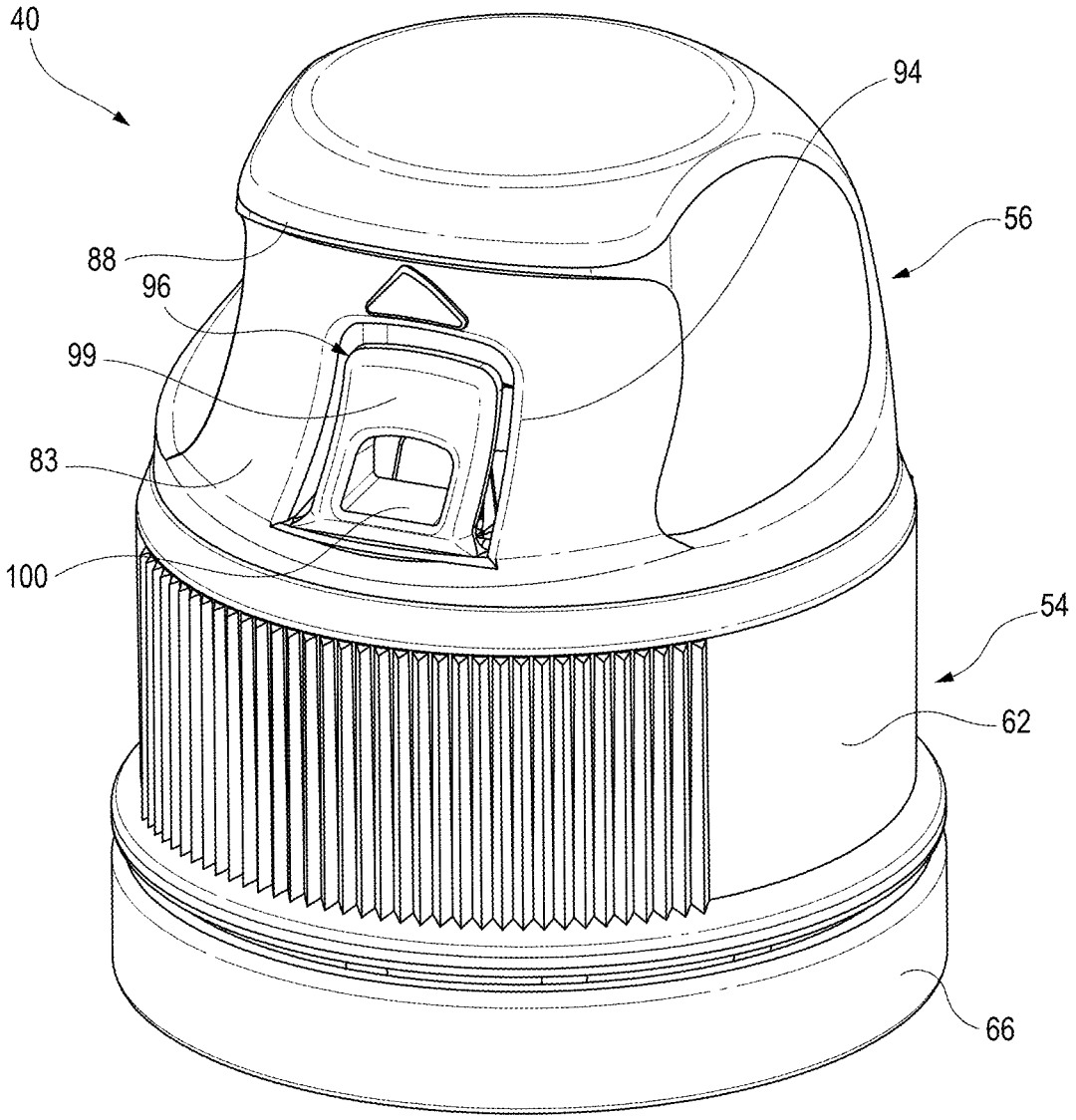
FIG. 2 is an isometric view, from the top, front, and right side, of only the dispensing closure of FIG. 1.
Figure 3:
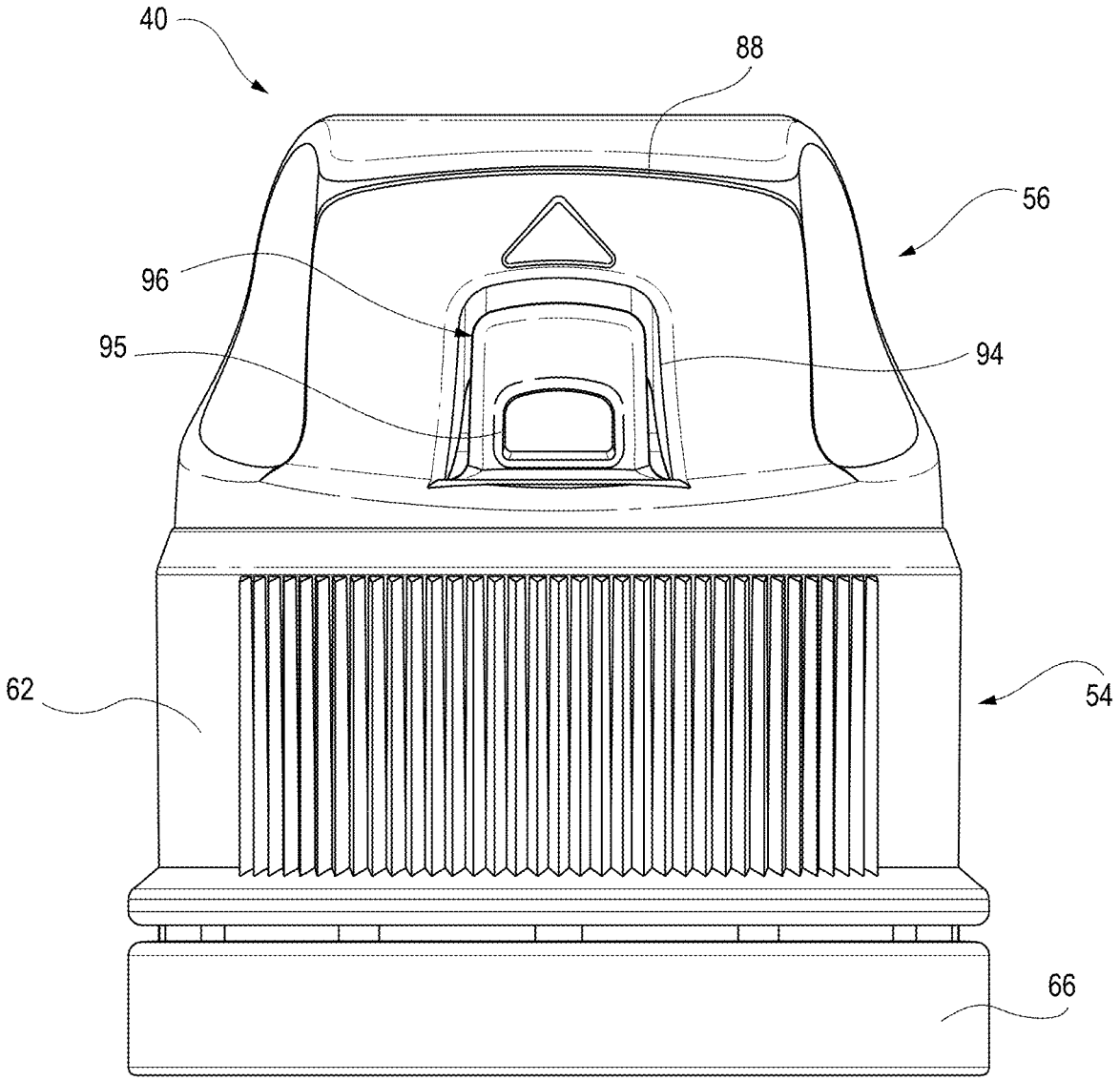
FIG. 3 is a front elevational view of the dispensing closure shown in FIG. 2.
Figure 4:
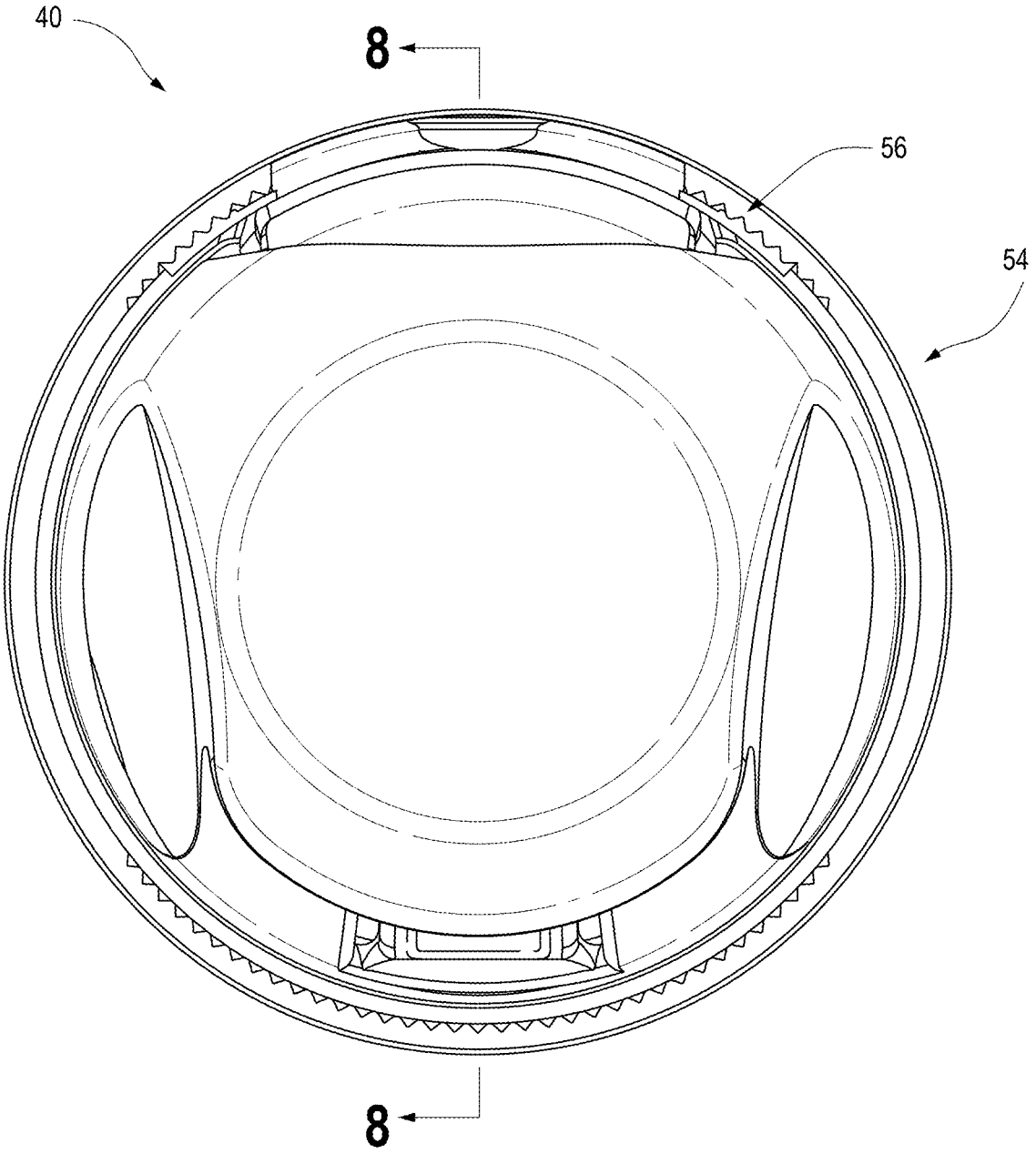
FIG. 4 is a top plan view of the dispensing closure shown in FIG. 2.
Figure 5:
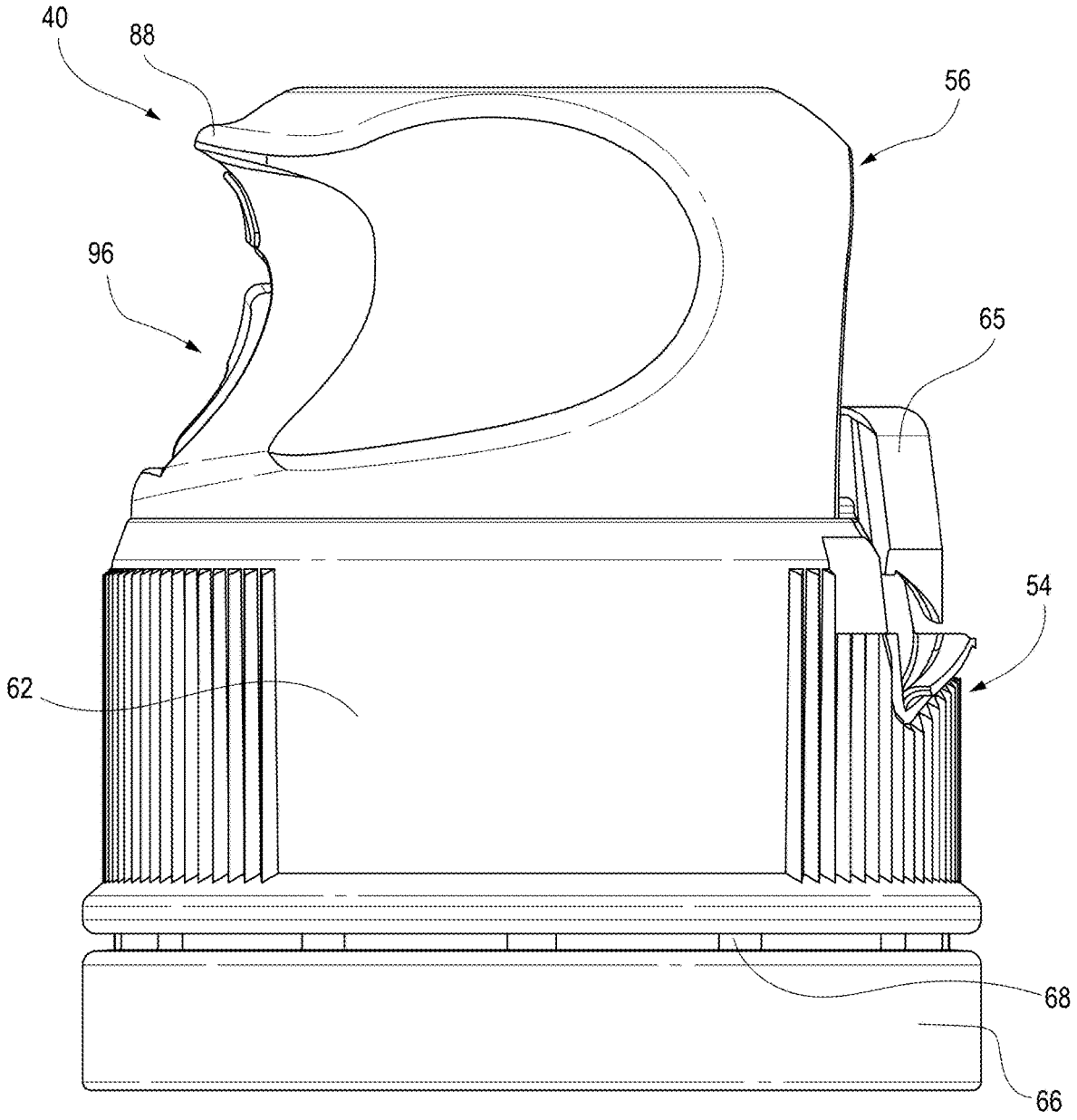
FIG. 5 is a right-side elevational view of the dispensing closure shown in FIG. 2, the left side being the mirror image thereof.

For ease of description, the dispensing closure 40 (or simply referred to hereinafter as a "closure") of this invention is described in a typical (upright) position, that the dispensing closure would have when installed at the opening of an upright container 44 of a substance or product (the upper end of the container being illustrated in the form of an upright bottle in FIGS. 1 and 19 only), and terms such as upper, lower, radial, axial, above, below, lateral, etc., are used with reference to this position and with respect to the central axis 45 that extends vertically through the center of the closure 40 (visible in FIGS. 8, 10, 12, and 14). It will be understood, however, that the dispensing closure embodying this invention may be manufactured, stored, transported, used, and sold in an orientation other than the position described.

The dispensing closure of the present invention is suitable for use with a variety of conventional or special containers, the details of which, although not fully illustrated or described, would be apparent to those having skill in the art and an understanding of such containers. The particular containers, per se, that are described herein form no part of, and therefore are not intended to limit, the broad aspects of the present invention.

The illustrated preferred embodiment of the dispensing closure of the present invention will typically be used on a container of a material or substance (e.g., a product such as a lotion, fluent food, or drink substance) that can be dispensed, or otherwise removed, from the container through the opened closure. The product may be, for example, a fluent substance such as a liquid, cream, powder, slurry, or paste. If the container and closure are large enough, then the product could also be non-fluent, discrete pieces of material (e.g., food products such as nuts, candies, crackers, cookies, etc., or non-food products including various items, particles, granules, etc.) which can be removed through an open closure by hand from a container, or scooped out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

FIGS. 1-21 illustrate a preferred embodiment of a dispensing closure 40, or subcomponents thereof, incorporating non-frangible tamper evidence features according to the present invention. The preferred embodiment of the dispensing closure 40 has central axis 45 (FIG. 8) and the basic components of a body 54 for being located at the opening 46 of a container 44 (e.g., shown FIGS. 1 and 19), a closing element or lid 56 movably connected to the body 54, and a spout 60 extending through the body 54 and covered by the lid 56. As will be discussed below, the present invention encompasses non-preferred embodiments that do not include a spout 60, per se, but which still include the advantageous non-frangible tamper evidence features of the present closure 40 in the body 54 and lid 56 alone.

The spout 60 defines a passage (described in detail hereinafter) through which a substance can flow or otherwise move from the interior of the container 44 to the external environment. In the illustrated preferred embodiment, the closure 40 is provided in the form of a separate article which is especially suitable for being attached to the container 44 that would typically contain contents such as a product or products consisting of articles or fluent material. Such a container 44 could be a collapsible, flexible pouch (not illustrated) with appropriate modification to the body 54 into a fitment, or the container 44 may be a generally rigid vessel which may have somewhat flexible, resilient walls, such as a bottle or tank.

However, it will be understood that the container 44 may be some other type of container or vessel for a substance, which may include, or be part of, for example, a medical device, processing machine, dispenser, reservoir on a machine, etc., wherein the container 44 has an opening 46 to the container interior. The container 44, per se, such as a bottle, pouch, or other vessel, per se, does not form a part of the broadest aspects of the present invention, per se. The container 44 may have any configuration suitable for the intended use.

The container 44, or a portion thereof, may be made from a material suitable for the intended application (e.g., a thin, flexible material for a pouch wherein such a material could be a polyethylene terephthalate (PET) film or a polyethylene film, or a thicker, less flexible material for a bottle wherein such a less flexible material could be injection-molded polyethylene or polypropylene).

In applications wherein the body 54 of the closure 40 is mounted to a container 44 such as a bottle or pouch, it is contemplated that typically, after the closure manufacturer makes the closure 40 (e.g., by molding the closure components, i.e., the body 54, lid 56, and the spout 60, from thermoplastic polymers and assembles them together in an initially assembled orientation of the lid 56 defining an unactuated, initially closed position or condition), the closure manufacturer will then ship the closed closure 40 to a filler facility at another location where the container 44 is either manufactured or otherwise provided, and where the container 44 is filled with a product. However, for some applications, the components of the closure 40 could be shipped by the closure manufacturer in an unassembled condition to the filler facility for subsequent assembly.

If the container 44 is a collapsible pouch as illustrated, then the closure body 54 may include a suitable conventional or special fitment portion (as illustrated and as will be discussed in detail below) that can be attached to the pouch as the pouch is being made and filled, or as the pouch is being made but before the pouch is subsequently filled through the body 54 of the unassembled closure 40 or through open regions of the pouch walls that are later sealed closed.

In the illustrated preferred embodiment of the invention, the closure 40 is preferably provided as an assembly of the body 54, lid 56, and spout 60 that together define an article (i.e., the closure 40) for being attached to a container 44. The illustrated preferred embodiment of the closure 40 is especially suitable for being removably attached (e.g., mounted or installed) to a container 44 in the form of a bottle. However, it will be appreciated that in some applications it may be desirable for the closure 40 to be attached to a container 44 in a manner that would not permit a user to remove the closure 40 from the container 44. Further, it may be desirable for the closure 40 (or at least the body 54 of the closure 40) to be formed as an integral, unitary part, or extension, of the container 44 (e.g., a pouch or bottle) wherein such a unitary part or extension also (i.e., simultaneously) defines an end structure (or other portion) of the container 44, per se. In one form, the body 54 could encompass the entire container 44, per se.

Where the container 44 is a bottle, the bottle typically includes an upper end portion or other suitable structure on some part of the bottle that defines the bottle mouth portion (i.e., a portion that defines an opening to the bottle interior), and such a mouth portion of a bottle typically has a cross-sectional configuration with which the closure 40 is designed to engage. The main body portion of the bottle may have a cross-sectional configuration that differs from the cross-sectional configuration of the bottle mouth portion (as illustrated). On the other hand, the bottle may instead have a substantially uniform shape along its entire length or height without any portion of reduced size or different cross-section. The bottle may have a generally rigid or flexible wall or walls which can be grasped by the user.

The particular embodiment of the closure 40 illustrated in FIGS. 1-21 is especially suitable for use with a container 44 having a substantially flexible wall or walls that can be squeezed or deflected laterally inwardly by the user to increase the internal pressure within the bottle so as to force the product out of the bottle and through the opened closure. In a bottle with a flexible wall or walls, such a flexible wall or walls typically have sufficient, inherent resiliency so that when the squeezing forces are removed, the bottle walls return to the normal, unstressed shape.

In other applications it may be desirable to employ a generally rigid container 44, and to pressurize the container interior at selected times with a piston or other pressurizing system to force the product out through the open closure, or to reduce the exterior ambient pressure so as to suck the product out through the open closure 40.

In the illustrated embodiment of the present invention, the closure 40 includes a specially configured closure body 54 and lid 56 which have cooperating, non-frangible tamper evidence features. As explained hereinafter, the user's initial or partial opening of the lid 56 of the closure 40 will permanently alter the physical condition of the closure 40 so as to create or provide evidence of tampering to subsequent users of the initial opening or partial opening of the closure 40.

The closure body 54, the lid 56, and the spout 60 are each preferably molded from a suitable thermoplastic material such as polyethylene, polypropylene, or the like. In a presently preferred form of the closure 40, the body 54 and the lid 56 are molded as a unitary structure from the same thermoplastic material, while the spout 60 is molded separately and subsequently assembled with the body 54 and the lid 56 to form a subassembly prior to being installed upon the container 44. Other materials may be employed instead.

As will be discussed in greater detail below, the Figures of the present application show the lid 56 of the closure 40 in various moved positions. The next few paragraphs will briefly summarize the positions illustrated.

FIGS. 1, 9-10, and 19 illustrate the assembled closure 40 with the lid 56 located in an initially closed position or condition as would be encountered by a user or consumer. FIGS. 1, 9-10, and 19 may be characterized as also illustrating the lid 56, spout 60 (visible in FIGS. 10 and 19), and body 54 in an initially assembled orientation which prevents, but can be subsequently operated to permit, communication of a substance through the closure 40.

FIGS. 2-8 show the closure 40 prior to full insertion, retention, or installation of the spout 60 within the closure body 54. As will be discussed in greater detail below, installation of the spout 60 forces the non-frangible tamper evidence features of the lid 56 and the body 54 to engage in the initially closed position of the lid 56, which would be encountered by the consumer.

FIGS. 11 and 12 show the lid 56 of the closure 40 being initially opened (i.e., opened for the first time) by a user prior to the complete disengagement of the tamper evident features of the lid 56 and body 54.

Figure 13:
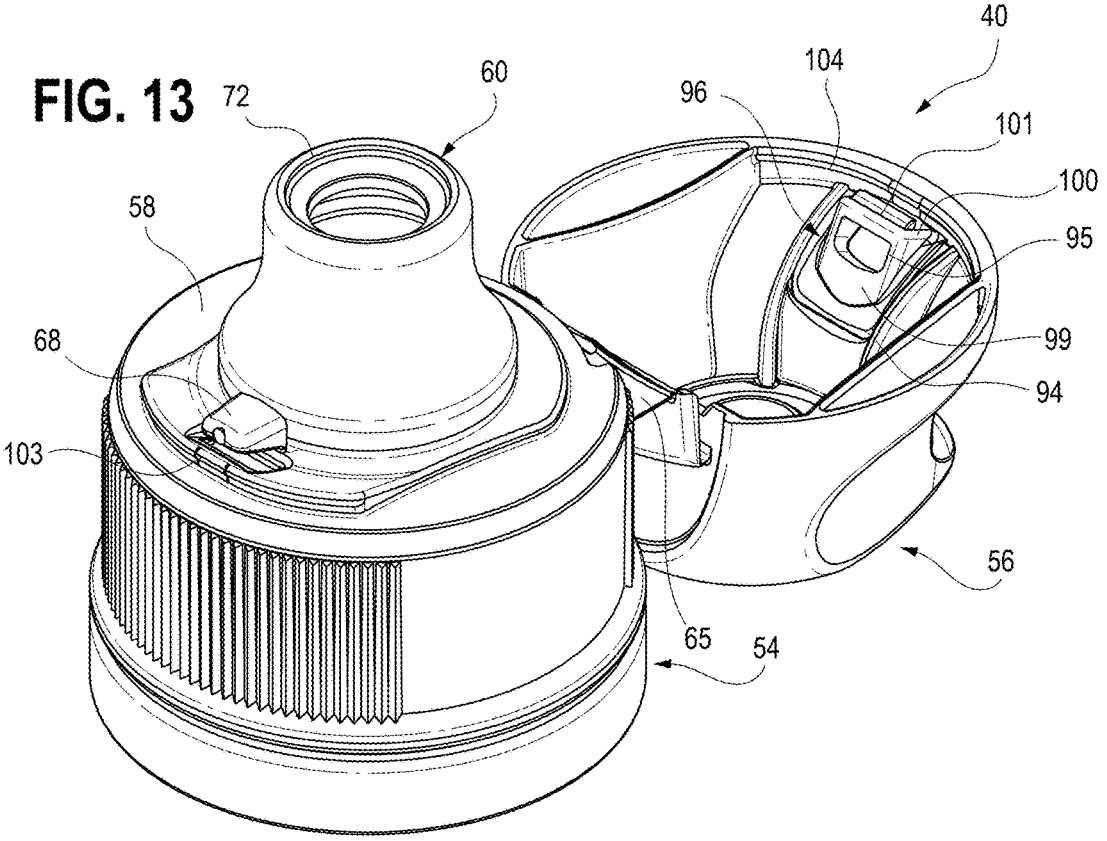
FIG. 13 is an isometric view, from the top front and right side, of the dispensing closure similar to FIG. 11, however.
Figure 14:
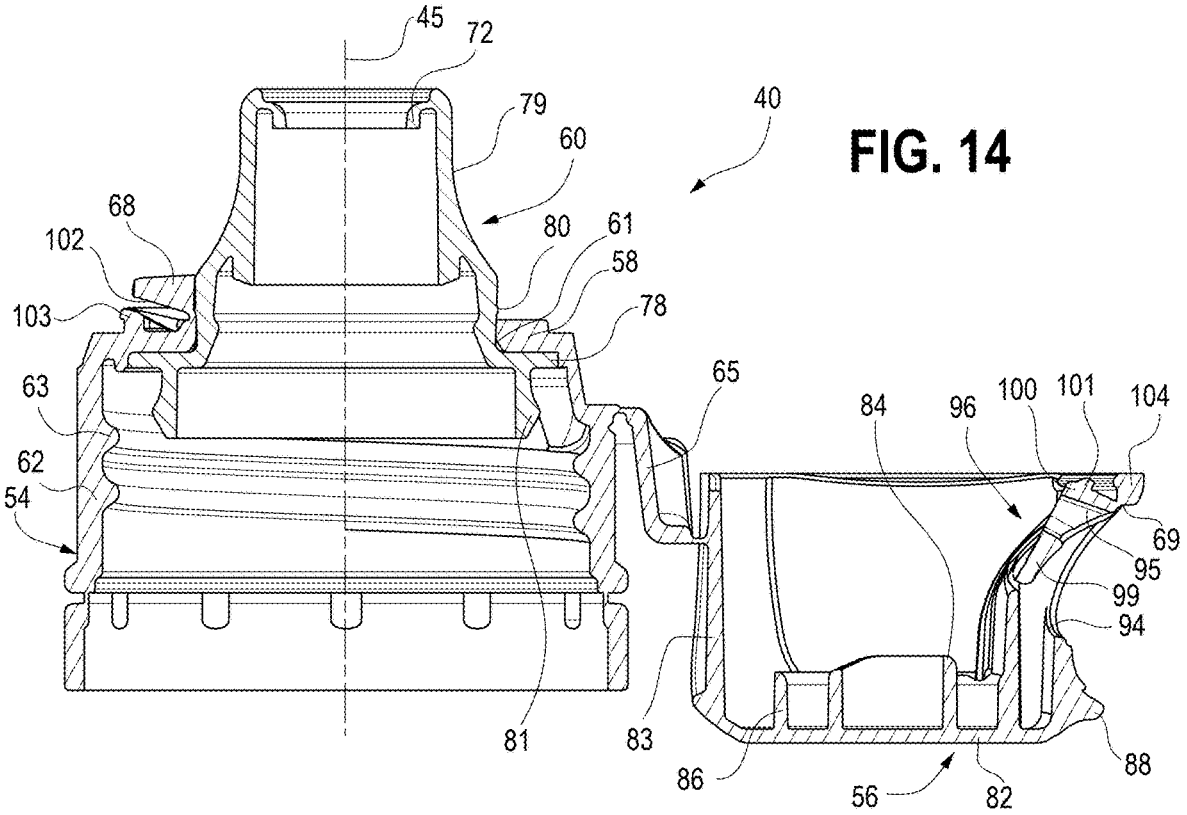
FIG. 14 is a cross-sectional view of the dispensing closure shown in FIG. 13, taken generally along the same view plane 8-8 in FIG. 4.

FIGS. 13 and 14 show the lid 56 of the closure 40 being moved into a fully open position to expose the spout 60 for permitting dispensing a fluent substance from the container 44 through the open closure 40 (such as by inverting the package containing the container 44 and the closure 40).

FIGS. 15 and 16 show the lid 56 of the closure 40 being reclosed or moved into a subsequently closed position by a user such that the tamper evident means of the lid 56 and the body 54 are initially re-engaging.

FIGS. 17 and 18 show the lid 56 of the closure 40 moved into a subsequently closed position whereby the tamper evidence features are changed to visually indicate to a user that the closure 40 has been previously opened.

With reference to the accompanying FIG. 10, the illustrated preferred embodiment of the closure 40 of the present invention includes a generally hollow base or body 54 and an integrally-formed lid 56 that is connected to the body 54. The body 54 includes a top end or deck 58 which defines an interior side facing the interior of the container 44 (i.e., axially inward, or downward in the figures) and an exterior side facing the ambient environment (i.e., axially outward, or upward in the figures). The deck 58 further includes a circular orifice 61 therein, centered on the axis 45, permitting the installation or insertion of the spout 60 therethrough. A wall or skirt 62 extends axially inwardly or downwardly from the deck 58. The skirt 62 includes means or internal threads 63 for receiving external threads 49 (visible in FIG. 19) or other connecting means of the container 44 to secure the body 54 to the container 44. It will be understood that the body 54 may have other attachment means for engaging features on the container 44, such means including, but not limited to, snap-fit beads and grooves, toggle clamps, friction fittings, locks, adhesives, welding, etc., located on any portion of the body 54 to secure the body 54 at the opening 46 of the container 44.

Figure 6:
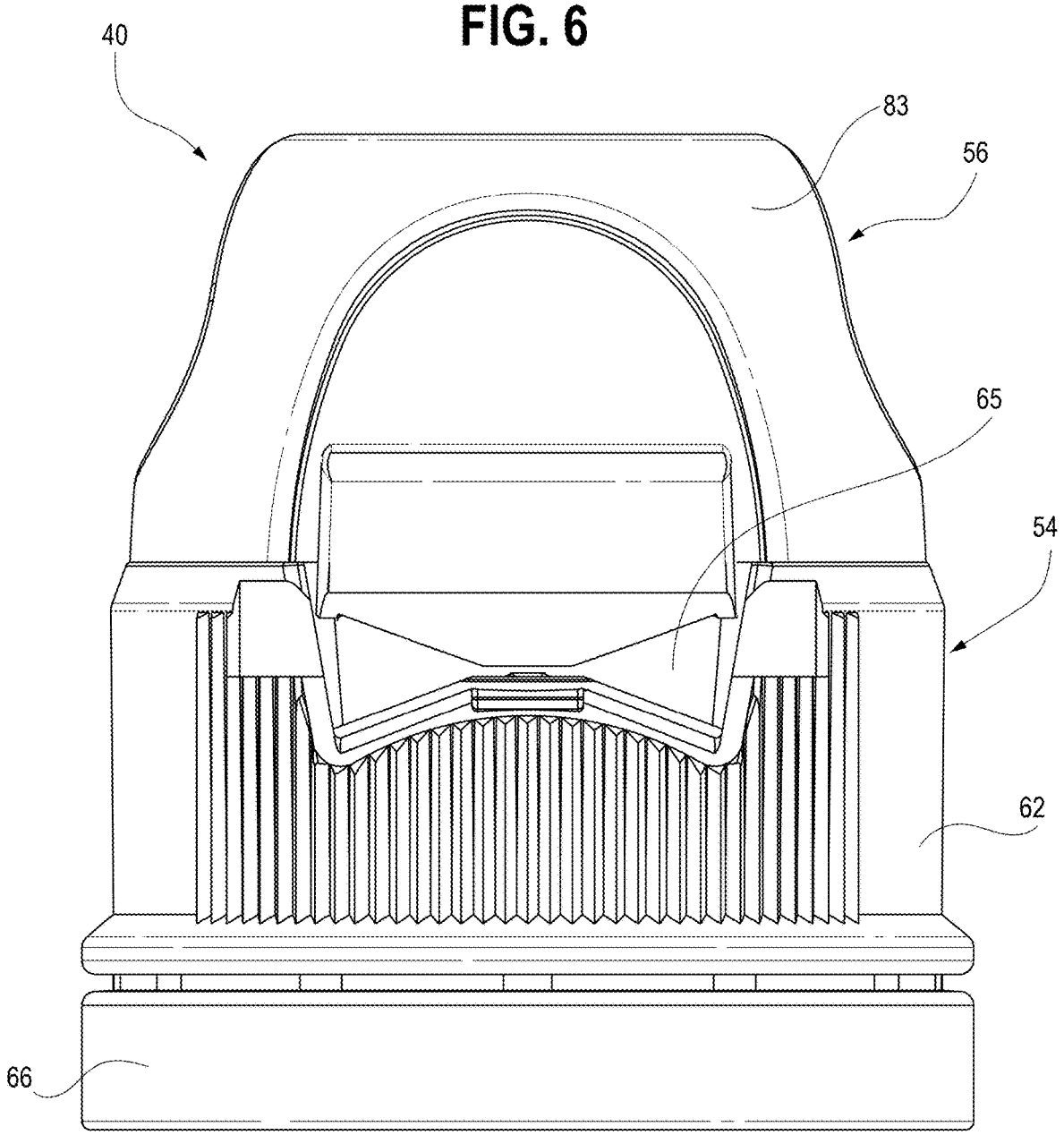
FIG. 6 is a rear elevational view of the dispensing closure shown in FIG. 2.
Figure 7:
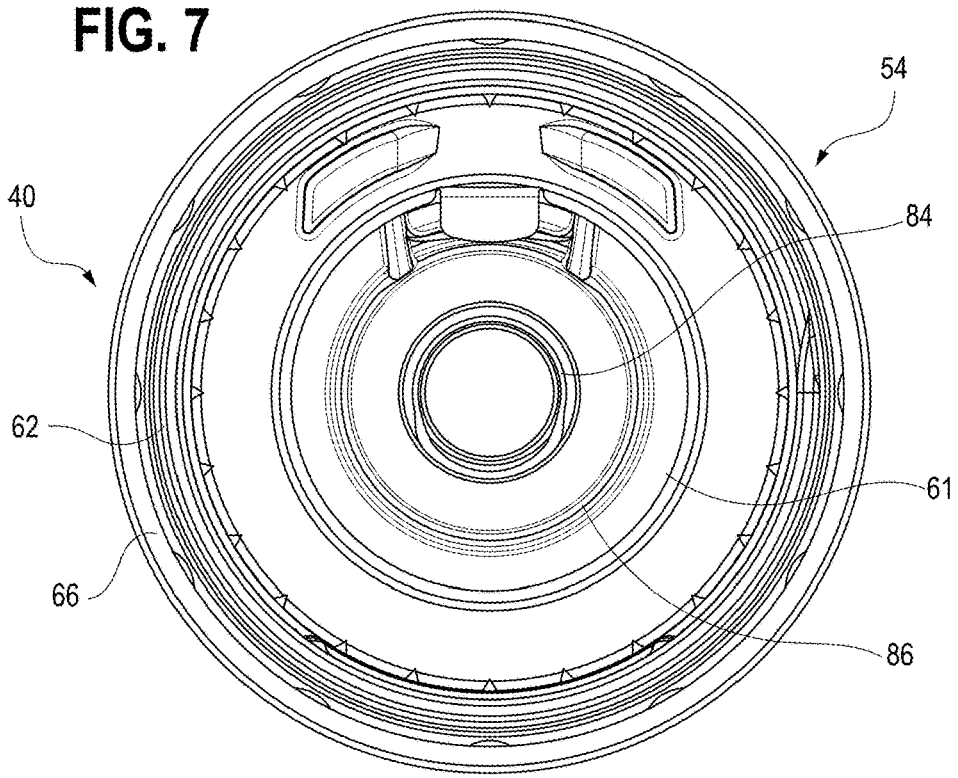
FIG. 7 is a bottom plan view of the dispensing closure shown in FIG. 2.

With reference now to FIGS. 6 and 14, the lid 56 is connected to the body 54 by a hinge 65. The hinge 65 is molded unitarily with the lid 56 and the closure body 54 near the deck 58 (visible in FIG. 14) so as to accommodate movement of the lid 56 between an open position or condition exposing the spout 60, and the closed position or condition occluding or sealing the spout 60. The hinge 65 may be of any suitable conventional or special design. For example, the hinge 65 illustrated in the figures may be of a conventional snap-action type such as described in the U.S. Pat. No. 5,356,017 or U.S. Pat. No. 5,642,824, the details of which form no part of the broadest form of the present invention. The hinge 65 could also be a non-snap-action type, including a strap or tether. The lid 56 may mated with the body 54 in a wholly removable manner, such as by mating screw threads, friction, or snap fit beads, etc.

Figure 8:
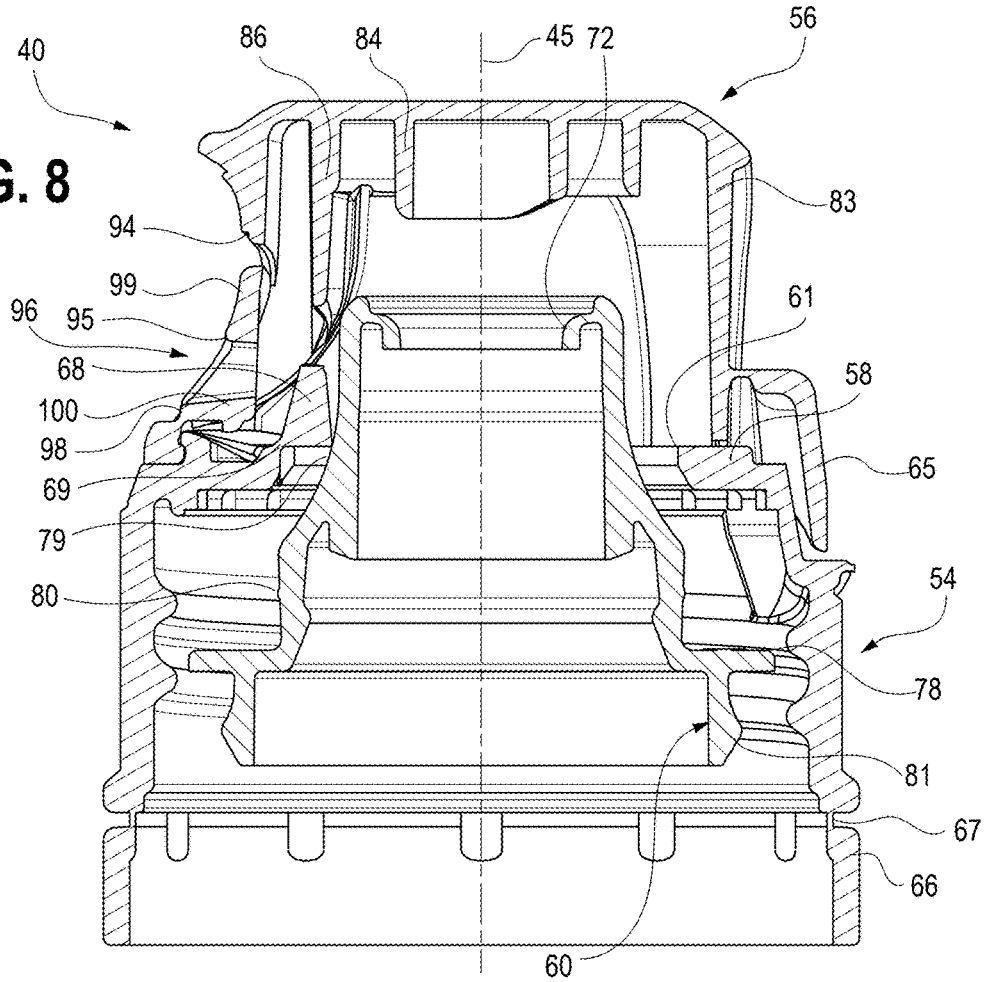
FIG. 8 is a cross-sectional view of the dispensing closure shown in FIG. 2, taken generally along view plane 8-8 in FIG. 4.

As can be seen in FIG. 8, the axially inward or lower end of the body 54 may optionally be provided with a stay-with type tamper evidence tether, strap, or band 66 that permits partial removal or separation of the closure 40 from the container 44, such as for cleaning or recycling purposes. The tether 66 includes a plurality of frangible bridges or elements 67 which extend circumferentially between portions of the tether 66. The frangible elements 67 are configured to break under tension when the body 54 is rotated a predetermined amount relative to the container 44. Breaking of the frangible elements 67 permits the tether 66 to expand axially away from the opening 46 of the container 44. The tether 66 may be omitted altogether in the broadest aspects of the present closure 40 invention.

With reference to FIGS. 8 and 10, the closure body 54 includes a non-frangible locking pin 68 extending from the deck 58, or any other portion of the body 54, by a pivot point or hinge 69 (designated in FIG. 8), and which has an initial or as-molded configuration (FIG. 8) that is generally vertical or axially extending and parallel to the central axis 45. The locking pin 68 further has a generally transverse (and preferably substantially horizontal) locking configuration (FIG. 10) moved relative to the initial configuration when confronted by a portion of the spout 60 (or other article such as the container 44, locking ring, valve, or other sufficiently rigid component of the closure or package upon which the closure is installed), which will be discussed in greater detail hereinafter.

Figure 21:
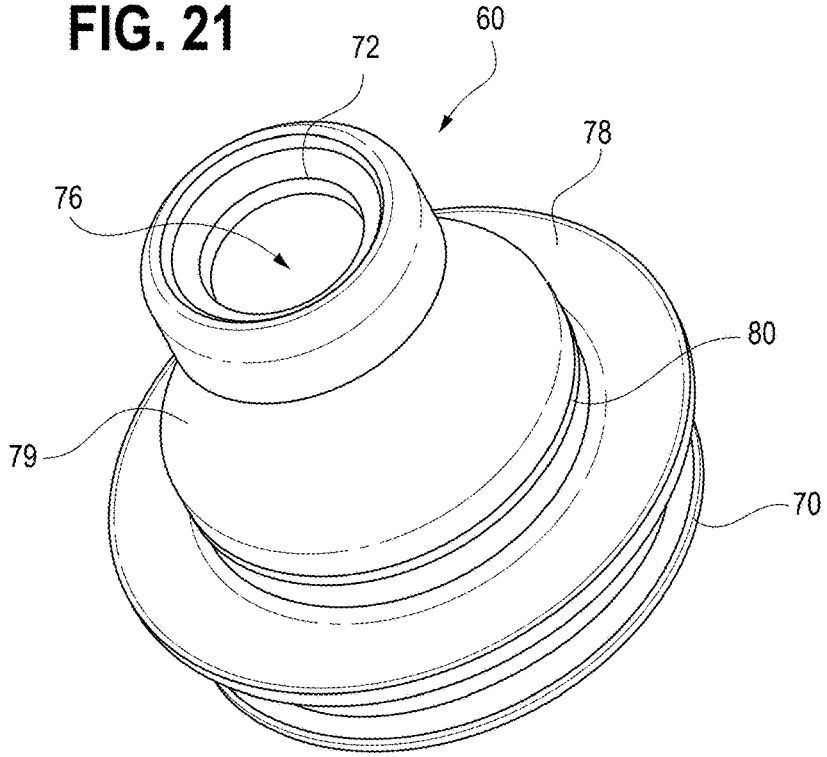
FIG. 21 is an isometric view, from the top right side, of the spout shown in FIG. 20.

Referring now to FIGS. 14 and 21, the spout 60 is a generally cylindrical, hollow structure with an inlet orifice 70 (FIG. 21), an outlet or dispensing orifice 72, and a through or dispensing passage 76 extending between the inlet orifice 70 and dispensing orifice 72. The spout 60 includes a laterally extending annular flange 78 and a curved or tapering exterior surface 79 for cooperating with the locking pin 68 during installation of the spout 60 within the body 54 to urge the locking pin 68 from its initial configuration about the hinge 69 to the locking configuration. The spout 60 includes an upper bead or projection 80 for frictionally engaging around the orifice 61 on the top deck 58 of the body 54 and a lower plug seal 81 for sealing against the inside of the opening 46 of the container 44 (as shown in FIG. 19).

Referring to FIGS. 10 and 14, the lid 56 includes a top end 82 having an outer wall 83 for covering or enclosing the closure body 54 and spout 60. The top end 82 includes a downwardly extending, resilient plug seal 84 for sealing or occluding the dispensing orifice 72 on the interior of the spout 60 when the lid 56 is its initially closed position or subsequently closed position atop the body 54. The lid 56 further includes an annular sealing wall 86 for providing additional sealing around the exterior of the spout 60 with the lid 56 in a closed position. The dispensing orifice 72 of the spout and/or the lid plug seal 84 are sufficiently flexible to accommodate elastic deformation to establish a leak-tight seal therebetween. The dispensing orifice 72 of the spout 60 is circular and centered on the central axis 45 of the closure body 54. However, it will be understood that, in some applications, the dispensing orifice 72 and its corresponding plug seal 84 of the lid 56 may have other shapes, such as one or more slots and elongate plugs, a plurality of apertures and plugs, polygonal apertures and plugs, irregularly shaped apertures and plugs, etc. The lid 56 includes a lid lift projection 88 extending laterally outwardly above a deep recessed front surface 90 (FIG. 10) to permit a user's finger to grasp and rotate the lid 56 about the hinge 65.

With reference now to FIGS. 8 and 10, the lid 56 includes a window or aperture 94 that is elongate in the circumferential or horizontal direction and in the vertical or axial direction, and that extends around the bottom portion of the lid 56 in its initially closed position and its subsequently closed position. A tamper evidence tab 96 extends from the wall 83 of the lid 56, proximate to the bottom of the aperture 94, by way of a non-frangible hinge 98. The tamper evidence tab 96 has a bifurcated shape when viewed in a vertical cross-sectional plane extending through the center of the tab 96 and the central axis 45, defining an upper portion 99 and a lower portion 100 having a projection 101 that is configured to contact a feature on the body 54 in the locking configuration (as seen in FIG. 10), and is further configured to release from beneath the locking pin 68 to create an audible and/or tactile indication to a user of the closure 40 when the lid 56 is moved away from its initially closed position into an open position (FIGS. 12 and 14). The upper portion 99 and lower portion 100 of the tamper evidence tab 96 define a tab window 95 between them for receiving the locking pin 68 in the locking configuration.

With reference to FIGS. 9 and 10, the upper portion 99 of the tamper evidence tab 96 is deeply recessed within the aperture 94 of the lid 56 in the initially closed position of the lid 56. In this position, the upper portion 99 may contact the spout 60. The upper portion 99 extends transversely to the lower portion 100 when viewed in a vertical cross-sectional plane extending through the center of the tamper evidence tab 96 and the central axis 45 (as viewed in FIG. 10).

The locking pin has an inclined lower surface 102 (FIG. 14) for contacting the lower portion 100 of the tamper evidence tab 96 with the lid 56 in its initially closed position and the locking pin 68 in its locking configuration. Still referring to FIG. 14, the closure body 54 and lid 56 are provided with cooperatively engaging latch portions 103, 104 to maintain the lid 56 in its initially closed position. Specifically, the lid latch portion 104 and the deck latch portion 103 are located such that the deck latch portion 103 confronts the tamper evidence tab 96 in the initially closed position of the lid 56 to assist the confining of the tamper evidence tab 96 lower portion 100 beneath the locking pin 68 (as can be seen in FIG. 12).

The inventor has found that the arrangement of the locking pin 68 and the tamper evidence tab 96 of the closure 40 provides a more easily manufactured closure with a robust tamper evidence feature that does not require the incorporation of difficult to manufacture frangible elements, which may require drop pockets or shielding walls that may be especially difficult to manufacture for small diameter closures. Furthermore, the locking pin 68 and tamper evidence tab 96 together present a more consistent initial opening force compared to the inconsistent tear force of prior art frangible tamper evidence features of closures. The non-frangible tamper evidence means of the locking pin 68 and tab 96 of the closure 40 engage in a solid structural manner that can further better survive shipping and handling of the closure 40 compared to the frangible tamper evidence means of the prior art. Furthermore, the tamper evidence tab 96 having a bifurcated structure with a tab window 95 permits the tamper evidence tab 96 to have a greatly improved visibility of its state of change to a user of the closure, as will be discussed in greater detail below.

Initially, the body 54 and the lid 56 are molded or otherwise provided as a unitary structure, while the spout 60 is molded or otherwise provided as a separate component. Subsequently, in a preferred process, the manufacturer assembles the body 54 and lid 56 with the spout 60 by first moving the lid 56 into the initially closed position (such that the aperture 94 and tamper evidence tab 96 are located proximate to the locking pin 68, as shown in FIG. 8), and then moving the body 54 and spout 60 together along the axis 45 so as to force the spout 60 into and through the orifice 61 of the top deck 58 of the body 54. Continued axial movement of the spout 60 and body 54 of the closure 40 causes the curved exterior surface 79 of the spout 60 to be forced against the locking pin 68, causing the locking pin 68 to rotate about its pivot point or hinge 69 to a locking configuration of the lid 56. In the locking configuration, visible in FIG. 10, the locking pin 68 rotates horizontally overtop of, and concealing from the user, the lower portion 100 of the tamper evidence tab 96, such that the upper portion 99 of the tamper evidence tab 96 is deeply recessed within the aperture 94 of the lid 56 and the locking pin 68 prominently protrudes into or through the aperture 94 in the lid 56 and the tab window 95 to provide a clear indication of an unactuated, untampered closure 40. The retention bead or rib 80 of the spout 60 slips over the top deck 58 in the body 54 to securely retain the spout 60 with the body 54. The latches 103, 104 engage between the lid 56 and the body 54. The lid 56 is thus retained securely in its initially closed (i.e., unactuated) position by the locking pin 68 and spout 60 engagement.

Figure 19:
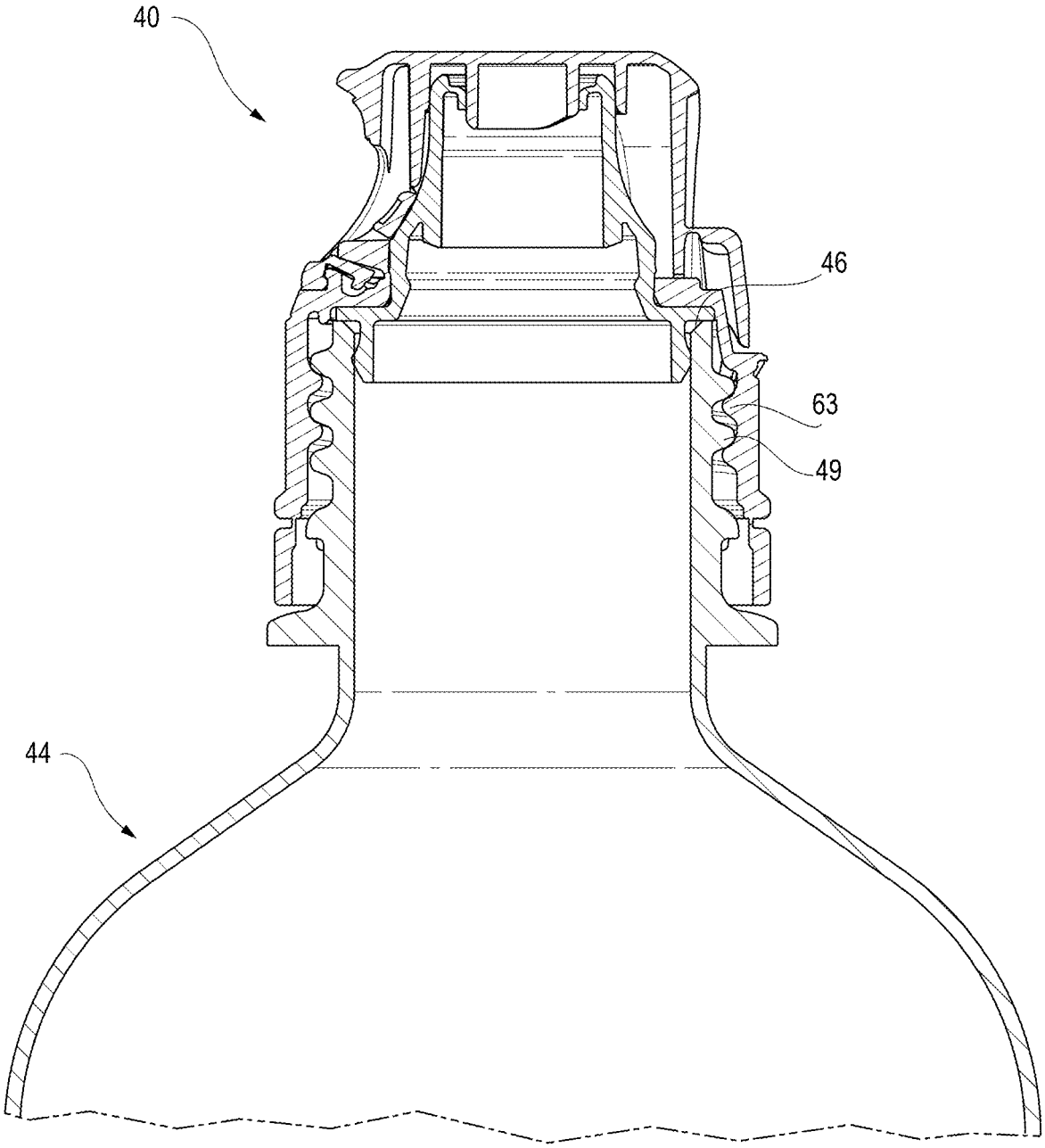
FIG. 19 is a cross-sectional view of the dispensing closure and container shown in FIG. 1, taken generally along a vertical cross-sectional plane similar to 8-8 in FIG. 4.
Figure 20:
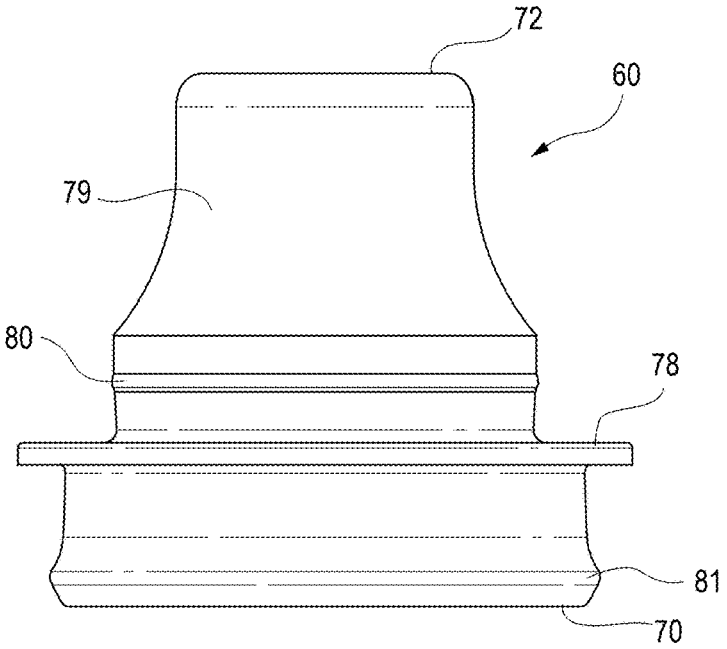
FIG. 20 is a right-side elevational view of only the spout shown in FIG. 8.

With reference to FIG. 19, after the assembly of the body 54, lid 56 and spout 60 into the closure 40 of the present invention (which would typically be shipped to a filler or bottler), the closure 40 is assembled to the container 44 by means of engaging the body thread 63 with the container thread 49 after filling of the container 44 with a fluent substance to secure the closure 40 at the opening 46 of the container 44.

One preferred method of using or actuating the closure 40 of the present invention, when assembled on a container 44 of a fluent substance in the form of a package, will now be discussed. With reference to FIGS. 9 and 10, the user would encounter the closure 40 with the locking pin 68 protruding into the aperture 94 and obscuring the lower portion 100 of the tamper evidence tab 96, and the lid 56 located and secured in its initially closed position as manufactured. In this position, the upper portion 99 of the tamper evidence tab 96 is deeply recessed within the aperture 94 of the lid 56 away from, and inaccessible to, the user.

With reference to FIGS. 11 and 12, the user would engage the lid lift projection 88 while gripping the closure 40 or container 44 to begin to rotate the lid 56 relative to the body 54 about the hinge 65 from the initially closed position to an open position. FIG. 12 shows that the lower portion 100 of the tamper evidence tab 96 slips along the tapered underside surface 102 (FIG. 14) of the locking pin 68, and the locking pin 68 stretches axially upward and outward from the pulling force of the moving lid 56. When the projection 101 of the lower portion 100 of the tamper evidence tab 96 releases from beneath the locking pin 68, the stored potential energy releases in an audible and/or tactile click to indicate to a user that the closure 40 has been opened for the first time. Movement of the lid 56 toward an open position begins to unseal the plug 84 and sealing wall 86 from engagement with the spout 60. Movement of the lid 56 withdraws the locking pin 68 from the aperture 94 of the lid 56 and the tab window 95.

With reference to FIGS. 13 and 14, the lid 56 may be moved by the user into an open or fully open position as shown to permit dispensing of a fluent substance from the container interior through the dispensing passage 76 (FIG. 21) and out of the spout 60 from the exposed dispensing orifice 72.

With reference to FIG. 16, the lid 56 may be moved by the user away from the open or fully open position toward a subsequently closed or re-closed position. Movement of the lid 56 toward the subsequently closed position causes the projection 101 of the lower portion 100 of the tamper evidence tab 96 to abut the top surface of the locking pin 68, urging the tamper evidence tab 96 radially or laterally outward toward the aperture 94. Furthermore, movement of the lid 56 toward the subsequently closed position causes the plug 84 and sealing wall 86 to reseal around and within the spout 60.

With reference to FIG. 18, the lid 56 may be further moved by the user into the subsequently closed or re-closed position. Further movement of the lid 56 into the subsequently closed position causes the tamper evidence tab 96 to be moved further laterally outward by contact with the locking pin 68, thus rotating the tamper evidence tab 96 about its hinge 98 into or fully through the aperture 94 to provide a clear indication to a user that the closure 40 has been actuated or opened. In this position, the upper portion 99 of the tamper evidence tab 96 is moved a great distance in the radial direction outwardly from the aperture 94. The configuration of the locking pin 68 and the tamper evidence tab 96 ensures that the tamper evidence tab 96 cannot re-enter its restrained position beneath the locking pin 68 after initial opening of the closure 40. The laterally outward face of the tab 96 may contain indicia (e.g., a symbol or the word "open") or a different finish or color from the remainder of the lid 56 such that it is quite apparent to a user that the closure 40 has been actuated.

In an alternate embodiment of the invention (not illustrated), the locking pin 68 of the closure body 54 may be hingedly connected to the skirt 62 by a vertically-extending hinge 69 (instead of the horizontally extending hinge 69 as illustrated) such that the locking pin 68 rotates in a different manner laterally outwardly to extend into the aperture 94 in the lid 56 to secure the lid 56 and tamper evidence tab 96 in an initially closed position. Accordingly, engagement of the locking pin 68 by the spout 60 or some other body (e.g., the top end of a closure, a movable portion of the closure, a valve retention ring, a valve, etc.) urges the locking pin 68 in a radial or lateral direction into the aperture 94 to secure and secure a portion of the tamper evidence tab 96 in this alternate embodiment of the present invention.

In yet another alternate embodiment of the invention (not illustrated), the closure 40 need not be provided with any spout 60 or secondary component or structure, such that installation of the closure body 54 alone atop a container opening causes the container 44 to effect the movement of the locking pin 68 into its locking configuration through the aperture 94 of the lid 56 to cover and conceal a portion of the tamper evidence tab 96. However, this alternate embodiment of the closure 40 would not permit the advantageous shipping of the closure 40 to the bottler or filler with the lid 56 securely affixed to the closure body 54 by the engagement of the locking pin 68 and tamper evidence tab 96 to prevent premature opening of the lid 56 from its initially closed position. In this embodiment, the orifice 58 of the body 54 would be the dispensing orifice of the closure 40, and the top deck 58 may include an integral spout therein.

Various modifications and alterations to this invention will become apparent to those skilled in the art without departing from the scope and spirit of this invention. Illustrative embodiments and examples are provided as examples only and are not intended to limit the broadest scope of the present invention.

What is claimed is:

1. A dispensing closure for use in dispensing a substance stored within an interior of a container, said dispensing closure comprising:

a body for being located at an opening of the container, said body having a deck including at least one orifice, said body having a skirt depending from said deck with means for attaching said body to the container, said body having a locking pin extending therefrom, said locking pin having an initial configuration and a locking configuration moved relative to said initial configuration;

a spout retained within said body, said spout defining an inlet orifice, a dispensing orifice, and a dispensing passage extending through said spout to accommodate flow of the substance from the interior of the container through said spout, wherein with said spout retained within said body said locking pin is located in said locking configuration; and a lid connected to said body and movable between an initially closed position occluding said dispensing orifice of said spout, an open position exposing said dispensing orifice of said spout, and a subsequently closed position returned from said open position and occluding said dispensing orifice of said spout said lid having an aperture and a tamper evidence tab, wherein in said initially closed position of said lid said locking pin is located in said locking configuration within said aperture and said tamper evidence tab is retained beneath said locking pin; and wherein in said subsequently closed position of said lid said tamper evidence tab is rotated laterally outwardly through said aperture to indicate evidence of tampering to a user of the dispensing closure.

2. The dispensing closure in accordance with claim 1 wherein said locking pin is configured to rotate between said initial configuration and said locking configuration by insertion of said spout within said body.

3. The dispensing closure in accordance with claim 1 wherein said locking pin extends parallel to a central axis of said body in said initial configuration; and said locking pin extends transverse to said central axis in said locking configuration.

4. The dispensing closure in accordance with claim 1 wherein said tamper evidence tab is configured to rotate into said aperture in said lid by contact with said locking pin during movement of said lid from said open position to said subsequently closed position.

5. The dispensing closure in accordance with claim 1 wherein said tamper evidence tab defines a projection on a lower side that engages said locking pin during movement of said lid from said open position to said subsequently closed position.

6. The dispensing closure in accordance with claim 1 wherein said tamper evidence tab is configured to produce an audible and/or tactile indication to the user of the closure when said lid is moved from said initially closed position into said open position.

7. The dispensing closure in accordance with claim 1 wherein said tamper evidence tab is connected to said lid by a non-frangible hinge and wherein said locking pin is connected to said body by a non-frangible hinge.

8. The dispensing closure in accordance with claim 1 wherein said tamper evidence tab includes a tab window defined between an upper portion and lower portion for receiving said locking pin with said lid in said initially closed position and said locking pin in said locking configuration.

9. The dispensing closure in accordance with claim 8 wherein said upper portion is recessed within said aperture of said lid in said initially closed position.

10. The dispensing closure in accordance with claim 8 wherein said upper portion extends transversely to said lower portion when viewed in a cross-sectional plane extending through a central axis of said body and a center of said tamper evidence tab.

11. The dispensing closure in accordance with claim 8 wherein said locking pin has an inclined lower surface for contacting said lower portion of said tamper evidence tab with said lid in said initially closed position and said locking pin in said locking configuration.

12. The dispensing closure in accordance with claim 1 wherein said deck has a deck latch portion and said lid has a lid latch portion, said deck latch portion and said lid latch portion cooperatively engaging to maintain said lid in said initially closed position, and wherein said deck latch portion is located on said body to confront said tamper evidence tab with said lid in said initially closed position and said locking pin in said locking configuration.

13. The dispensing closure in accordance with claim 1 wherein said tamper evidence tab contacts said spout with said lid located in said initially closed position and said locking pin in said locking configuration.

14. The dispensing closure in accordance with claim 1 wherein said spout has a tapering exterior surface and a flange extending radially around said tapering exterior surface, and wherein contact between said tapering exterior surface and said locking pin rotates said locking pin into said locking configuration.

15. The dispensing closure in accordance with claim 1 in combination with the container of the substance, said dispensing closure and said container of the substance together defining a package.

16. A method of manufacturing a dispensing closure for use in dispensing a substance stored within an interior of a container, said method comprising the steps of:

obtaining a body for being located at an opening of the container, said body having a deck including at least one orifice, said body having a skirt depending from said deck with means for attaching said body to the container, said body having a locking pin extending therefrom, said locking pin having an initial configuration and a locking configuration moved relative to said initial configuration, said body having a lid connected thereto and movable between an initially closed position, an open position, and a subsequently closed position returned from said open position, said lid having an aperture and a tamper evidence tab;

obtaining a spout defining an inlet orifice, a dispensing orifice, and a dispensing passage extending through said spout to accommodate flow of the substance through said spout; and inserting said spout through said at least one orifice in said body with said lid in said initially closed position whereby said spout moves said locking pin into said locking configuration within said aperture and said tamper evidence tab is retained beneath said locking pin.

17. A method of opening a package including the dispensing closure, said method comprising the steps of:

obtaining the package including a container and a dispensing closure installed upon said container, said dispensing closure having A) a body located at an opening of said container, said body having a deck including at least one orifice, said body having a skirt depending from said deck with means for attaching said body to said container, said body having a locking pin extending therefrom, said locking pin having an initial configuration and a locking configuration moved relative to said initial configuration;

B) a spout retained within said body, said spout defining an inlet orifice, a dispensing orifice, and a dispensing passage extending through said spout to accommodate flow of a substance from an interior of the container through said spout, wherein, with said spout retained within said body, said locking pin is located in said locking configuration; and C) a lid connected to said body and movable between an initially closed position occluding said dispensing orifice of said spout, an open position exposing said dispensing orifice of said spout, and a subsequently closed position returned from said open position and occluding said dispensing orifice of said spout, said lid having an aperture and a tamper evidence tab, wherein in said initially closed position of said lid said locking pin is located in said locking configuration within said aperture and said tamper evidence tab is retained beneath said locking pin;

moving said lid from said initially closed position to said open position; and moving said lid from said open position to said subsequently closed position, wherein said tamper evidence tab is rotated laterally outwardly into said aperture by contact with said locking pin to indicate evidence of tampering to a user of the closure.

* * * * *